US007806621B2

(12) United States Patent
Leroyer

(10) Patent No.: US 7,806,621 B2
(45) Date of Patent: Oct. 5, 2010

(54) LOCKING DEVICE FOR CONNECTOR ASSEMBLY

(75) Inventor: Serge Leroyer, Le Mans (FR)

(73) Assignee: Souriau, Versailles (FR)

( * ) Notice: Subject to any disclaimer, the term of this patent is extended or adjusted under 35 U.S.C. 154(b) by 54 days.

(21) Appl. No.: 11/657,955

(22) Filed: Jan. 25, 2007

(65) Prior Publication Data

US 2008/0012330 A1 Jan. 17, 2008

(30) Foreign Application Priority Data

Jan. 26, 2006 (FR) ..... 06 50283

(51) Int. Cl.
*H01R 4/30* (2006.01)
*H01R 4/38* (2006.01)

(52) U.S. Cl. ..... 403/308; 403/299; 403/300; 439/321

(58) Field of Classification Search ..... 403/299, 403/300, 308, 314; 439/320–323, 351, 352, 439/363, 372

See application file for complete search history.

(56) References Cited

U.S. PATENT DOCUMENTS 3,552,777 A * 1/1971 Heinrich et al. ..... 439/321
3,786,396 A * 1/1974 Kemmer et al. ..... 439/321
3,808,580 A * 4/1974 Johnson ..... 439/321
3,917,373 A * 11/1975 Peterson ..... 439/321
4,322,121 A * 3/1982 Riches et al.
4,534,607 A * 8/1985 Tomsa
4,703,988 A * 11/1987 Raux et al. ..... 439/321
4,744,770 A * 5/1988 Drogo
4,808,117 A * 2/1989 Gale et al. ..... 439/321
4,900,260 A * 2/1990 Drogo ..... 439/321
5,035,640 A * 7/1991 Drogo ..... 439/321
5,041,004 A * 8/1991 Waldorf
5,199,894 A * 4/1993 Kalny et al. ..... 439/321
5,203,477 A * 4/1993 Lo
5,399,096 A * 3/1995 Quillet et al. ..... 439/321
6,086,400 A * 7/2000 Fowler ..... 439/321

FOREIGN PATENT DOCUMENTS

FR 2448794 A1 * 9/1980
FR 2 597 270 A1 10/1987
FR 2 696 049 A1 3/1994

* cited by examiner

*Primary Examiner*—Victor MacArthur
(74) *Attorney, Agent, or Firm*—Patterson Thuente Christensen Pedersen, P.A.

(57) ABSTRACT

A locking device designed to maintain the connection between a male connecting element and a female connecting element, and assembly including the locking device. The locking device includes a sleeve provided with a female thread designed to interact with a male thread of the female connecting element and indexing means housed in the sleeve and designed to interact with the male connecting element and to be indexed during screwing of the locking device onto the female connecting element. The locking device also includes a compression device mounted so that it sides in the sleeve and is capable of increasing a contact pressure between the indexing means after screwing.

7 Claims, 1 Drawing Sheet

LOCKING DEVICE FOR CONNECTOR ASSEMBLY

RELATED APPLICATION

The present application claims priority to French Application No. 06 50283 filed Jan. 26, 2006, which is incorporated herein in its entirety by reference.

TECHNICAL FIELD

The invention relates to a locking device designed to maintain the connection between two complementary electrical connecting elements of a connector assembly, such as a socket and plug. More precisely, the invention relates to a locking device comprising two degrees of stabilization of the connection, the second degree of stabilization being obtained progressively after the locking device has been assembled around the connecting elements.

BACKGROUND ART

FR 2 696 049 discloses a locking collar provided with weighted locking means. The locking collar is integral with a first electrical connecting element, and is provided with a female thread designed to interact with a male thread of a second complementary electrical connection. The weighted locking means comprise teeth that are asymmetrical in shape. The teeth of the weighted locking means interact with teeth of the second electrical connecting element that are also asymmetrical in shape. The weighting is provided using teeth, for each of the toothings, that are slightly inclined in the direction of screwing and are highly inclined in the direction of unscrewing in relation to the circumferential direction. During screwing, the respective toothings abut against each other until a final position is reached in which the connecting elements and the locking collar are totally immobilized. This total immobilization is obtained when the threaded sections have been screwed as far as possible. The presence of these weighted locking means considerably increases the torque to be applied in order to unscrew the collar whilst maintaining a low screwing torque in order to be able to screw this collar on easily.

However, the screwing means of the prior art suffers from the disadvantage that a constant locking and unlocking force is required throughout screwing.

SUMMARY OF THE INVENTION

Locking devices are used in the field of aeronautical and automobile connector engineering. In fact, in these applications strong vibrations may result in a loss of the connection between the complementary connecting elements. The locking device according to the invention enables the connection to be maintained between the connecting elements even when they are subject to strong vibrations. The locking device according to the invention is preferably a weighted locking device designed to be screwed to a connecting element. Weighted locking device is understood to mean that the torque to be applied in order to unscrew the device is higher than that required to screw it on.

The object of the invention is to provide a locking device suitable for keeping complementary elements of a connector assembly connected to each other, even under extreme operating conditions.

To achieve this, the invention proposes a locking device which, in addition to a given locking force throughout screwing, also requires, after screwing, an additional force to allow maximum locking tightness. This additional force after screwing enables a higher level of locking to be obtained, thereby guaranteeing that the connecting elements are kept connected in all operating conditions, and particularly in the case of strong vibrations.

More precisely the invention proposes a locking collar provided with a push rod, the push rod being active only at the end of travel, i.e. at the end of screwing of the collar to an electrical connecting element. Throughout screwing, the toothing of the locking collar, whether asymmetrical or not, interacts with the complementary toothing of the electrical connecting element, which necessitates supplying an equal and constant locking force. During screwing the push rod slides in the direction of the toothings. At the end of travel, i.e. during the last screwing turns of the locking collar, the push rod compresses the two toothings one against the other. In order to continue screwing it is therefore necessary to provide a higher locking force. Similarly, in order to unscrew the locking collar it is necessary to provide an additional force until the push rod is released and no longer compresses the two toothings. In order to continue the unscrewing it is therefore sufficient to apply an equal and constant unscrewing force. Moreover, the user knows when he has reached the end of the locking travel because he must apply an additional force. The user is therefore informed that the collar has been correctly locked. Moreover, such a locking collar may advantageously be used with the connecting elements of the prior art.

The object of the invention is therefore a locking device designed to maintain the connection between a male connecting element and a female connecting element, the locking device comprising a sleeve provided with a female thread designed to interact with a male thread of the female connecting element and an indexing assembly housed in the sleeve, the indexing assembly being designed to interact with the male connecting element and to be indexed during screwing of the locking device on the female connecting element, characterized in that it also comprises a compression device mounted so that it slides in the sleeve and is capable of increasing a contact pressure between the indexing assembly after screwing.

Contact pressure is understood to mean the compression of the indexing assembly, causing the indexing to be more restricting. Because the elements of the indexing assembly are compressed one against the other, the contact between the different elements of the indexing assembly are increased, rendering screwing more difficult.

According to the locking embodiments according to the invention, it is possible to provide all or some of the following additional characteristics:

The locking device comprises an elastic return washer arranged between the compression device and the indexing assembly. The elastic return means enables a contact pressure to be maintained between the indexing means throughout screwing.

The compression device comprises a compression ring, designed to be retained between the inner wall of the sleeve and the outer wall of the male connecting element, and at least one protuberance integral with the compression collar and designed to interact with the female connecting element after screwing so that the compression device can be slid in the direction of the indexing assembly. Advantageously, these four protuberances are arranged in pairs diametrically opposite one another so that the compression device is supported in a balanced fashion on the female connecting element. Similarly, and more generally, the protuberances are advantageously and regularly distributed throughout the perimeter of the compression ring to allow balanced sliding of the compression device during screwing of the female connecting element.

In one embodiment, the indexing assembly comprises an outer notched washer designed to be fixed to the outer wall of the male connecting element and an inner notched washer integral with the inner wall of the sleeve.

The notched outer and inner washers are fitted with teeth whose pitches favor the screwing of the locking device and oppose the unscrewing of the device. The locking device therefore has weighted locking.

The locking device is provided with a centripetal circumferential offset, the compression device being maintained in translation between the said centripetal circumferential offset and the indexing means.

The invention also relates to a connector assembly comprising a female connecting element, a male connecting element and a locking device according to the invention for maintaining the connection between the male and female connecting elements.

According to the embodiments of the connector assembly according to the invention it is possible to provide all or some of the following characteristics:

The female element is a socket and the male element is a plug. The locking device is then preferably mounted in free rotation on the plug and screwed to the socket.

A retention circlip axially retains the locking device along the male connecting element.

BRIEF DESCRIPTION OF THE DRAWINGS

The invention will be better understood upon reading the following description and upon examining the accompanying figures. They are presented for information purposes and in no way restrict the scope of the invention. The figures show.

DETAILED DESCRIPTION

Figure 1:
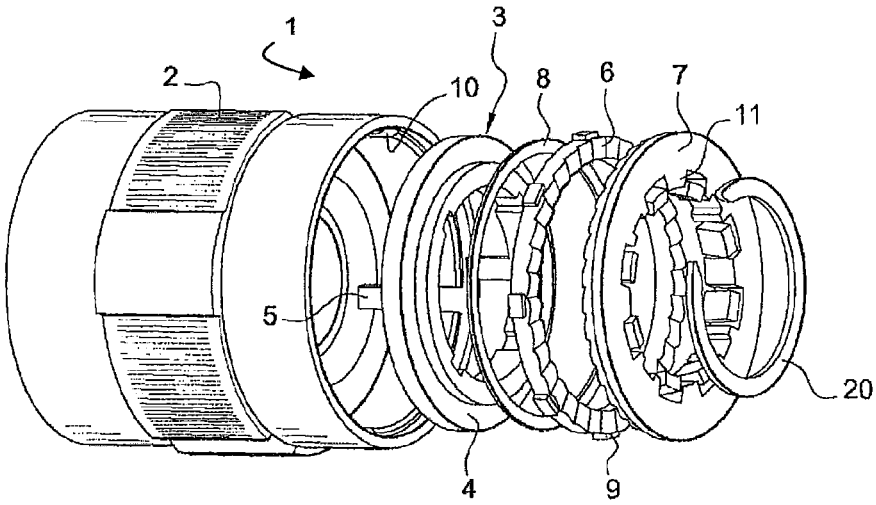
FIG. 1 is an exploded view of the locking device according to the invention.

Different unassembled elements of a locking device 1 according to the invention are shown in FIG. 1.

Locking device 1, or collar 1, comprises a tubular cylindrical sleeve 2, inside which the different rings and washers of collar 1 are fitted.

A compression device 3, or push rod, fitted with a compression ring 4 and four protuberances 5 (only two are shown in FIG. 1), is housed in sleeve 2. Compression device 3 is orientated in sleeve 2 so that compression, ring 4 is directed towards the indexing assembly comprised in one embodiment of notched washers 6 and 7 of locking device 1, whilst protuberances 5 are directed towards the opposite end of sleeve 2. The outside diameter of compression ring 4 is substantially smaller than the inside diameter of sleeve 2, so that the said compression ring 4 is able to slide along inter wall 10 of the said sleeve 2.

An elastic washer 8 is arranged between compression device 3 and the indexing assembly. The elastic washer is designed to be compressed between the compression device 3 and the indexing assembly during screwing of locking device 1 onto a connecting element.

Figure 2:
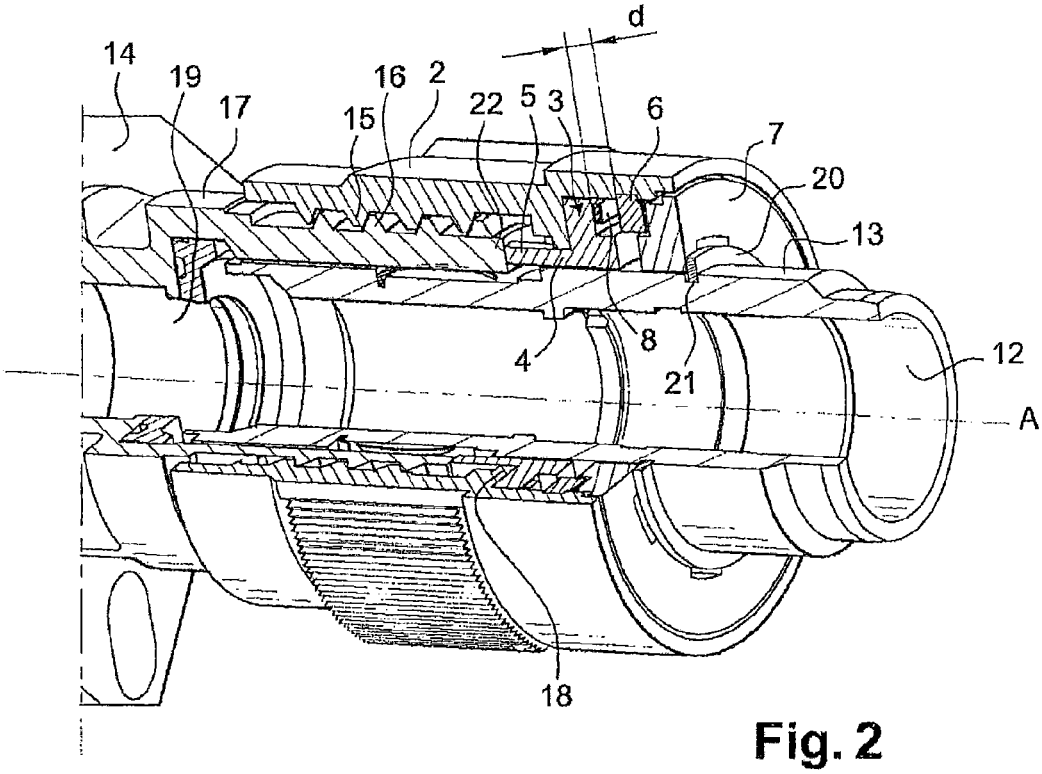
FIG. 2 is a representation of a connector assembly according to the invention, the locking device of which is not yet fully screwed to the socket.

The indexing assembly according to the embodiment shown in FIGS. 1 and 2 comprises a first notched washer 6 and a second notched washer 7, arranged one in relation to the other so that their respective toothings face each other. The toothings of the two notched washers 6 and 7 are complementary and are designed to be interlocked one inside the other. The outside diameters of the two notched washers 6 and 7 are essentially equal to the inside diameter of sleeve 2.

The first notched washer 6, or inner washer, is provided with an outer circumference of radial projections 9 directed outwards. These radial projections 9 are designed to interact with the corresponding housings arranged on inner wall 10 of sleeve 2 so that the said inner notched washer 6 is immobilized, both in rotation and translation, in sleeve 2. Conversely, the second notched washer 7, or outer washer, is provided with centripetal radial projections 11, i.e. directed inwards. These radial projections 11 are designed to interact with corresponding housings arranged on outer wall 13 of plug 12 (FIG. 2), on which locking device 1 is designed to be mounted. Outer washer 7 is therefore immobilized, both in rotation and translation, on plug 12.

Inner washer 6 is designed to rotate relative to outer washer 7 during screwing of sleeve 2 of locking device 1 on a complementary socket 14 (FIG. 2) of plug 12. For this purpose sleeve 2 is provided, on its inner wall 10, with female thread 15 capable of interacting with a male thread 16 of socket 14, arranged on outer wall 17 of socket 14.

According to the invention, in order to use locking device 1 on the connector assembly of plug 12 and socket 14, compression device 3 is first inserted at the front end of sleeve 2 (on the right in the figures) in sleeve 2, protuberances 5 being directed towards the rear end of sleeve 2 (on the left in the figures). Compression device 3 is slid in the direction of the rear end until compression ring 4 abuts against a centripetal circumferential offset 18 arranged on a circumferential periphery of inner wall 10 of sleeve 2. The length of offset 18 is sufficient to serve to support compression ring 4, but does not retain protuberances 5. The length of offset 18 is understood to mean the dimension of the offset, which extends radially with respect to longitudinal axis A of the connector assembly. Compression ring 4 is therefore housed in a front section of sleeve 2, whilst protuberances 5, not retained by offset 18, are located in the rear section of sleeve 2, it being understood that the two sections of sleeve 2 are delimited by circumferential offset 18.

Before or after the insertion of compression device 3 in sleeve 2, elastic washer 8 is mounted on the front face of compression ring 4, opposite the face of ring 4 in contact with centripetal circumferential offset 18.

Inner notched washer 6 is then inserted in sleeve 2 by inserting projections 9 in the corresponding housings of the said sleeve 2. An initial distance d, fixed according to the requirements, separates the compression device 3 of inner notched washer 6. Compression device 3 is free in terms of translation, and can therefore slide between circumferential offset 18 and inner notched washer 6.

Outer notched washer 7 is then fixed to outer wall 13 of plug 12 by mounting projections 11 in the corresponding housings of outer wall 13 of plug 12.

Sleeve assembly 2, compression device 3, elastic washer 8 and inner notched washer 6 are then mounted on plug 12, at the end of the said plug 12 opposite that fitted with outer notched washer 7. Sleeve assembly 2 is then slid along inner wall 13 of plug 12 in the direction of outer washer 7 until the two notched washers 6 and 7 are brought into contact with each other.

In order to increase the degree to which locking device 1 is retained axially on plug 12 it is possible to provide a circlip 20, or locking ring. Circlip 20 is made, for example, of spring steel and has the shape of a split collar. Circlip 20 is partially housed in a circumferential notch 21 arranged on outer wall 13 of plug 12, upstream of outer notched washer 7. "Partially housed" is understood to mean that an inner perimeter of circlip 20 is housed in notch 21 so that it is fixed to outer wall 13 of plug 12, but that an outer perimeter of circlip 20 projects from outer wall 13 so that outer notched washer 7 abuts against circlip 20. Notched washers 6 and 7, and compression device 3, are therefore retained in sleeve 2, between offset 18 and circlip 20.

In a particular embodiment, outer notched washer 7 may serve as a dust trap in the sense that it protects the inside of sleeve 2 from contamination by blocking the passage of dust through it.

Plug 12 and locking device 1 are mounted jointly in socket 14 so that plug 12 is housed in the principal orifice 19 of socket 14, whilst sleeve 2 surrounds outer wall 17 of socket 14. Female thread 15 of sleeve 2 interacts with male thread 16 of socket 14.

It is therefore possible to start screwing locking device 1 to socket 14 so that plug 12 is retained in socket 14. Screwing sleeve 2 around socket 14 and plug 12 enables engaging means 6 and 7 to engage. The pitches of the toothings of notched washers 6, 7 are preferably low in the direction of screwing and high in the direction of unscrewing. This therefore simplifies screwing, whilst unscrewing requires a comparatively greater force.

After a certain number of screwing turns, front end 22 of socket 14 (on the right in FIG. 2), through which plug 12 has been inserted, comes into contact with protuberances 5. Protuberances 5 all have the same dimensions so that they all simultaneously come into contact with front end 22 of socket 14. Protuberances 5 are preferably distributed regularly around the circumference of compression ring 4 so that the contact between compression device 3 and socket 14 is balanced, and compression device 3 remains in axis A of the connector assembly during its translation. As screwing continues front end 22 repels protuberances 5 and hence also compression spring 4 in the direction of notched washers 6 and 7. Distance d between compression device 3 and the indexing assembly of washers 6 and 7 is then reduced until elastic washer 8 bears against inner notched washer 6. The more screwing continues, the more elastic washer 8 is compressed against inner notched washer 6, which is itself compressed against outer notched washer 7 fixed on plug 12. Since the toothings of washers 6 and 7 are increasingly interlocked in each other, it becomes increasingly difficult to continue screwing. It is necessary to apply a greater force, relative to the force required at the beginning of screwing. The end of screwing is accompanied by a clicking noise corresponding to each passage of the teeth. This clicking noise indicates to the user that he has arrived at the end of travel and that maximum locking has been achieved.

Of course, if it is desired to unscrew, it is also necessary to apply an additional force at the start of unscrewing. Once front end 22 of socket 14 is no longer in contact with protuberances 5 of compression device 3, the unscrewing force to be supplied is less.

Distance d initially separating the compression device of the indexing assembly may vary according to the applications. Similarly, the initial distance between protuberances 5 and the free end 22 of socket 14 may be of varying length. These distances are therefore easily adapted according to whether a contact is desired between socket 14 and compression device 3 sooner rather than later during the course of screwing, and/or whether a longer or shorter screwing travel is required.

The invention claimed is:

1. A connector assembly comprising:

a female connecting element comprising a socket;

a male connecting element; and a locking device operably connecting the male and female connecting elements, wherein the locking device includes:

a sleeve provided with a female thread defined on an inner wall of the sleeve, the female thread being engaged with a male thread of the female connecting element such that the locking device is in threaded engagement with the female connecting element;

an indexing assembly housed in the sleeve and engaged with the male connecting element and indexed by threaded engagement of the locking device to the female connecting element, the indexing assembly including a first washer and a second washer, each washer having teeth on an axially directed face of the washer, the first washer and second washer being positioned such that the teeth of the first washer interlock with the teeth of the second washer; and a compression device mounted and slidable within the sleeve, the compression device including a compression ring retained between the inner wall of the sleeve and an outer wall of the male connecting element, and at least one protuberance integral with the compression ring and protruding in an axial direction of the sleeve, wherein the at least one protuberance abuttably engages with the female connecting element thereby urging the compression device toward the indexing assembly, forcing the compression device into operable engagement with the second washer, increasing a contact pressure between the first washer and the second washer of the indexing assembly.

2. The connector assembly according to claim 1, wherein the male connecting element is a plug, and wherein the locking device is mounted freely in rotation on the plug and retained by screwing onto the socket.

3. The connector assembly according to claim 1, wherein a retaining circlip retains the locking device on the outer wall of the male connecting element.

4. A locking device adapted to establish and maintain a connection between a male connecting element and a female connecting element, the locking device comprising:

a sleeve presenting an inner wall having a female thread defined thereon, the female thread being engagable with a male thread of the female connecting element, the sleeve having a front section and a rear section separated by a centripetal circumferential flange formed on a periphery of the inner wall, wherein the sleeve is mountable on the male connecting element;

an indexing assembly including a first washer and a second washer, each washer having teeth on an axially directed face of the washer, the first washer presenting at least one radial projection receivable within a housing defined within the inner wall of the sleeve such that the first washer is fixedly mountable within the front portion of the sleeve, and the second washer presenting at least one centripetal projection receivable within a housing defined on an outer wall of the male connecting element such that the second washer is fixedly mountable to the male connecting element; and a compression device mountable and slidable within the sleeve between the centripetal circumferential flange of the sleeve and the first washer of the indexing assembly, the compression device including a compression ring, and at least one protuberance integral with the compression ring and protruding in an axial direction of the sleeve, wherein the compression device is mountable within the sleeve such that the compression ring is positioned in the front section of the sleeve and the at least one protuberance extends axially into the rear section of the sleeve beyond the centripetal circumferential flange;

wherein the teeth of the first washer engage the teeth of the second washer upon mounting of the sleeve to the male connecting element, and wherein the at least one protuberance of the compression device engages a front end of the female connecting element upon threaded engagement of the female thread of the inner wall of the sleeve and the male thread of the female connecting element, such that the compression device positioned within the front section of the sleeve is urged into operable engagement with the indexing assembly thereby increasing a contact pressure between the first washer and the second washer of the indexing assembly.

5. The locking device according to claim 4, wherein the compression device comprises four protuberances.

6. The locking device according to claim 4, further comprising an elastic washer positioned between the compression device and the indexing assembly.

7. The locking device according to claim 4, wherein the teeth of the first washer and the second washer have pitches that favor screwing of the locking device to the socket and oppose unscrewing of the locking device from the female connecting device.

* * * * *